United States Patent [19]

Gleim et al.

[11] Patent Number: 4,795,947

[45] Date of Patent: Jan. 3, 1989

[54] DEVICE FOR ELIMINATING THE INTERLINE FLICKER

[75] Inventors: Günter Gleim, VS-Marbach; Uwe Hartmann, Villingen-Schwenningen; Udo Mai, VS-Villingen; Fritz Ohnemus, Villingen-Schwenningen, all of Fed. Rep. of Germany

[73] Assignee: Deutsche Thomson-Brandt GmbH, Villingen-Schwenningen, Fed. Rep. of Germany

[21] Appl. No.: 149,904

[22] Filed: Jan. 28, 1988

Related U.S. Application Data

[63] Continuation of Ser. No. 888,325, filed as PCT EP85/00264, Nov. 16, 1985, published as WO86/03046, May 22, 1986, abandoned.

[30] Foreign Application Priority Data

Nov. 16, 1985 [WO] PCT Int'l Appl. ..... PCT/EP85/00264

[51] Int. Cl.[4] ..... H01J 29/52

[52] U.S. Cl. ..... 315/384; 315/370; 358/152

[58] Field of Search ..... 315/370, 384, 386; 340/728, 745; 358/152

[56] References Cited

U.S. PATENT DOCUMENTS

| | | | |
|---|---|---|---|
| 3,962,604 | 6/1976 | Guenard et al. | 315/391 |
| 4,415,889 | 11/1983 | Davis | 340/728 |
| 4,521,774 | 6/1985 | Murphy | 340/745 |

FOREIGN PATENT DOCUMENTS

| | | |
|---|---|---|
| 0053207 | 6/1982 | European Pat. Off. . |
| 2062401 | 5/1981 | United Kingdom . |

*Primary Examiner*—Theodore M. Blum
*Attorney, Agent, or Firm*—Max Fogiel

[57] ABSTRACT

A device enables to reproduce without flicker mixed signals from VT and/or BTX decoders during the reproduction of television signals (mixed operation). This is obtained by a video frequency scanning field compensation in the vertical direction effected by a video frequency additional connectable scanning amplifier which supplies a reduced inductivity additional scanning winding.

9 Claims, 1 Drawing Sheet

DEVICE FOR ELIMINATING THE INTERLINE FLICKER

CROSS-REFERENCE TO RELATED APPLICATION

Figure 1:
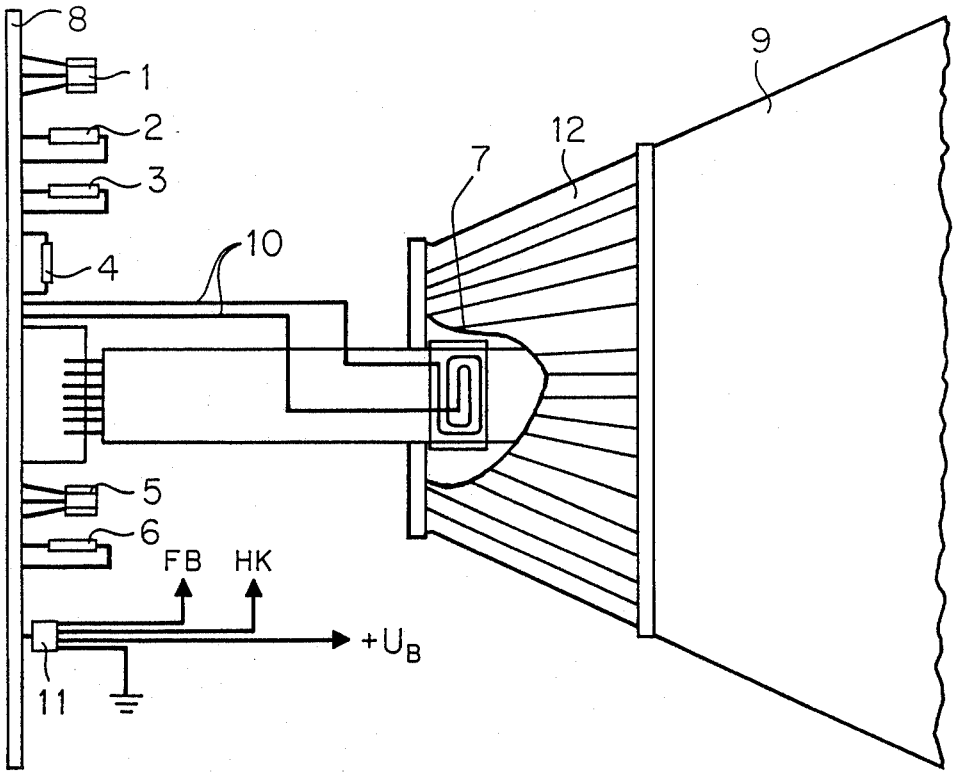

This application is a continuation of Ser. No. 888,325, filed as PCT EP85/00264 on Nov. 16, 1985, published as WO86/03046 on May 22, 1986, abandoned.

The point of departure for the invention is a device for eliminating interline flicker during the display of graphics on a playback screen, on a television picture tube for example, in conjunction with a television picture.

A television signal transmitted in accordance with the television standard is reproduced by the interlaced-scanning method. The purpose is to increase the rate of flicker to the extent that it becomes practically imperceptible. A picture is generated in the interlaced-scanning method by reproducing two adjacently traced fields, each with $k+\frac{1}{2}$ lines, with the fields interlaced in the form of a comb by tracing out the odd and even lines alternately. This increases the picture-replacement rate for a full picture. Interlaced scanning, however, has a serious drawback in that what is called interline flicker is particularly intense when still pictures, particularly graphics, are to be reproduced. Interline flicker is especially evident in the horizontal lines. Switching off the interlacing by tracing two fields one on top of the other is accordingly known in reproducing pictures of this type. Interline flicker characterized by vertical unsteadiness in the displayed picture is accordingly no longer apparent (German AS No. 2 949 020).

Simultaneously reproducing a transmitted television picture as background during the reproduction of a graphics is also known. Generally, switching off the interlaced scanning as just described results in the drawback of low resolution in the reproduced picture because the lines are paired. It would accordingly be desirable to prevent deterioration in the quality of the background television picture during this mixed operation as it is called. Thus, switching off interlaced scanning only while blanked graphics are being reproduced over the course of a few lines, at the bottom edge of the picture for example, is also known. Although the major portion of the picture is then satisfactory, however, resolution is less satisfactory while the rest of the graphics is being blanked. Interlaced scanning is switched off by means of additional vertical deflection of the electron beam with a main vertical-deflection winding.

Since, however, interlaced scanning is switched off over the course of a total line, the result is detrimental horizontal stripes superimposed on the television picture in the form of an interference pattern.

The object of the present invention is to eliminate interline flicker in the reproduction of blanked graphics without detriment to the quality of a simultaneously received television signal. This object is attained by the device recited in the major claim. Further embodiments of the invention will be evident from the subsidiary claims.

The advantage of the invention is that television-picture interlaced scanning and hence the quality of the overall picture is maintained even horizontally during the simultaneous reproduction of a television signal and display of graphics.

One embodiment of the invention will now be specified with reference to the drawing.

FIG. 1 is illustrates the circuitry involved in the invention and

Figure 2:
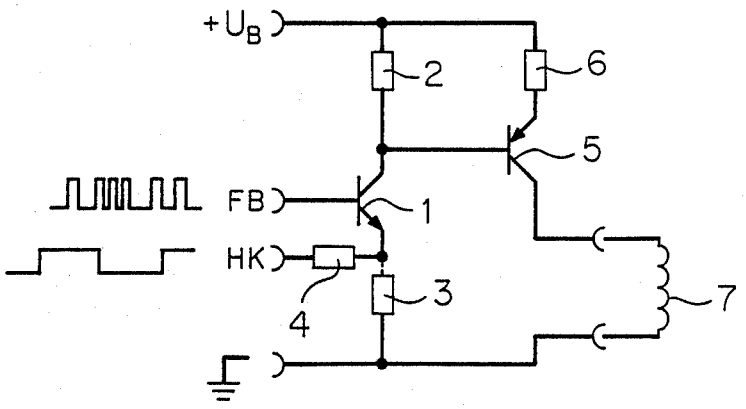

FIG. 2 how the invention is employed in a television receiver.

It is assumed that interlaced scanning is switched off while a videotext or teletext signal is being reproduced. The text decoder supplies for example a blanking signal, the function of which is to scan the suppressed television signal while the graphics are being blanked in order to increase the graphics contrast. The blanking signal is AND-connected in conjunction with the field-recognition signal. Fast-blanking signal FB is applied to the base of a npn transistor 1 with a collector connected to a source of operating voltage $+U_B$ through an operating resistor 2. The fast-blanking FB is a signal which appears always when a videotext graphics arises within the line. The emitter of transistor 1 is grounded through another resistor 3. A field-recognition signal HK is applied to the emitter through a preliminary resistor 4, making transistor 1 conducting only over the course of one field. The signal HK is characteristic of a predetermined video field, so that the supplemental vertical deflection occurs only during even-numbered or uneven-numbered video fields. The base of pnp transistor 5 is connected to the collector of transistor 1. The emitter of transistor 5 is connected to source of operating voltage $+U_B$ through a resistor 6 and its collector circuit contains a supplementary pair of deflection coils that are positioned on the neck of the picture tube in the vicinity of the main vertical-deflection winding in such a way that the current flowing through them occasions a supplementary vertical shift in the electron beam. The supplementary deflection generator already specified switches the interlaced scanning off only cover the duration of the blanked graphics. It must accordingly be capable of switching on and off at video frequency. The switchover time is on the order of 200 msec. The main deflection coil is accordingly, due to its high inductivity and its winding capacity, inappropriate for switching the interlaced scanning off. The existing deflection amplifier is also incapable of generating the requisite rapid change in current. A deflection generator with a basic frequency of 4.5 MHz is accordingly needed. The requisite deflection output can be applied in conjunction with a small supplementary deflection coil of low inductivity. The time constant L/R must be low because of the high switching rate. It is very cost-effective to employ a coil printed on a sheet of foil wrapped around the neck of the picture tube. It is essential to prevent the transistors in the deflection generator from going into the saturation range to avoid delaying the switchover procedure due to stored charge carriers. This can be ensured by selecting appropriate operating points for the transistors in the supplementary deflection generator. Small transistors are adequate because of the low deflection power. It is practical to mount the deflection generator on the same board 8 that the picture tube 9 is mounted on as illustrated in FIG. 2. It is essential for the lines 10 to the deflection coil 7 to be very short to keep their inductivity low. The pair of deflection coils is positioned on the neck of picture tube 9 below deflector unit 12, which is partly cut out to show deflection coil 7. The circuitry of the deflection generator is connected to the sources of signal and operating voltages on the chassis of the device through a plug-in connection 11.

We claim:

1. Apparatus for eliminating interline flicker display of graphics on a playback screen of a television picture tube, comprising: a supplemental deflection winding shifting an electron beam by substantially the width of one line over the duration of graphics reproduction; a supplemental deflection amplifier supplying said supplement deflection winding with current while the graphics are displayed; said supplemental deflection amplifier having transistors and an operating point set to prevent said transistors from becoming saturated; said supplemental deflection winding deflecting in vertical direction only during appearance of a videotext graphics within a line to retain line interlacing between graphics for reproducing a simultaneously moved television picture to be viewed.

2. Apparatus as defined in claim 1, wherein said supplemental deflection amplifier is located in substantially close proximity of said supplemental deflection winding for reducing line inductance.

3. Apparatus for eliminating interline flicker display of graphics on a playback screen of a television picture tube, comprising: a supplemental deflection winding shifting an electron beam by substantially the width of one line over the duration of graphics reproduction; a supplemental deflection amplifier supplying said supplemental deflection winding with current while the graphics are displayed; said supplemental deflection amplifier having transistors and an operating point set to prevent said transistors from becoming saturated; said supplemental deflection amplifer being positioned in substantially close proximity of said supplemental deflection winding for reducing line inductance; a mounting board mounted on said television tube, said supplemental deflection amplifier being positioned on said board; said television tube having a neck, said supplemental deflection winding comprising a coil of foil wrapped around said neck of said television tube; a coincidence circuit for generating a parameter controlling said supplemental winding out of coincidence of a fast-blanking pulse transmitted with a graphics signal and of a field-recognition signal; and a deflection amplifier deactivated or activated during coincidence for supplying said parameter controlling said supplemental winding.

4. Apparatus for eliminating interline flicker display of graphics on a playback screen of a television picture tube, comprising: a supplemental deflection winding shifting an electron beam by substantially the width of one line over the duration of graphics reproduction; a supplemental deflection amplifier supplying said supplemental deflection winding with current while the graphics are displayed; said supplemental deflection amplifier having transistors and an operating point set to prevent said transistors from becoming saturated, vertical deflection of said electron beam occurring only in existence of a videotext graphics.

5. Apparatus as defined n claim 4, wherein said supplemental deflection amplifier is positioned in substantially close proximity of said supplemental deflection winding for decreasing line inductivity.

6. Apparatus as defined in claim 4, including a mounting board mounted on said television tube, said supplemental deflection amplifier being mounted on said board.

7. Apparatus as defined in claim 4, wherein said television tube has a neck, said supplemental deflection winding comprising a coil of foil wrapped about said neck of said television tube.

8. Apparatus as defined in claim 4, including a coincidence circuit for generating a parameter controlling said supplemental winding out of coincidence of a fast-blanking pulse transmitted with a graphics signal and of a field-recognition signal.

9. Apparatus as defined in claim 4, including a deflection amplifier deactivated or activated during coincidence for supplying said parameter controlling said supplemental winding.

* * * * *